US007308213B2

(12) United States Patent
Sudo et al.

(10) Patent No.: US 7,308,213 B2
(45) Date of Patent: Dec. 11, 2007

(54) INTERMEDIATE TRANSFER BELT HAVING REFERENCE POSITION MARK

(75) Inventors: Masaki Sudo, Iwatsuki (JP); Yuichiro Inaba, Chigasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 301 days.

(21) Appl. No.: 11/012,155

(22) Filed: Dec. 16, 2004

(65) Prior Publication Data

US 2005/0238371 A1 Oct. 27, 2005

(30) Foreign Application Priority Data

Apr. 22, 2004 (JP) ..... 2004-126701

(51) Int. Cl.
*G03G 15/043* (2006.01)

(52) U.S. Cl. ..... 399/51; 399/301; 399/302

(58) Field of Classification Search ..... 399/49, 399/51, 66, 162, 165, 301, 302, 303, 308, 399/329, 312, 313; 347/116; 428/148, 328, 428/330; 198/810.03, 844.1; 226/45
See application file for complete search history.

(56) References Cited

U.S. PATENT DOCUMENTS 5,017,262 A * 5/1991 Riesing ..... 216/33
5,572,291 A * 11/1996 Moriguchi et al. ..... 399/390
6,408,146 B1 * 6/2002 Nagano ..... 399/67
7,076,195 B2 * 7/2006 Sakai ..... 399/301
2006/0002748 A1 * 1/2006 Kudo et al. ..... 399/302
2006/0120740 A1 * 6/2006 Yamada et al. ..... 399/49

FOREIGN PATENT DOCUMENTS

JP 60016840 A * 1/1985
JP 11024507 A * 1/1999
JP 11105444 A * 4/1999
JP 11-160928 A 6/1999
JP 11-184203 A 7/1999
JP 2000019901 A * 1/2000
JP 2002091115 A * 3/2002

* cited by examiner

*Primary Examiner*—Robert Beatty
(74) *Attorney, Agent, or Firm*—Sughrue Mion Pllc.

(57) ABSTRACT

In an image-forming apparatus having a photosensitive body and an intermediate transfer belt, the intermediate transfer belt is extendible/contractible in a longitudinal direction and a toner image formed on the photosensitive body transferred onto the intermediate transfer belt. The intermediate transfer belt has a mark formed from photo-reflective particles on one or both sides thereof, which mark has a different photo reflectivity to the intermediate transfer belt and is used for detecting a reference position of the intermediate transfer belt.

12 Claims, 8 Drawing Sheets

INTERMEDIATE TRANSFER BELT HAVING REFERENCE POSITION MARK

CROSS-REFERENCE TO RELATED APPLICATION

This application claims priority under 35 USC 119 from Japanese Patent Application No. 2004-126701 the disclosure of which is incorporated by reference herein.

BACKGROUND OF THE INVENTION

1. Field of the Invention

The present invention relates to an intermediate transfer belt, an image-forming apparatus, a transfer sheet, a mark-forming method, and a transferring apparatus. In particular, the present invention relates to an intermediate transfer belt wherein a mark formed thereon does not peel off or fade due to stretching or contraction in a longitudinal direction of the belt or due to abrasion by a cleaner, to an image-forming apparatus provided with the intermediate transfer belt, and to a transfer sheet, a mark-forming method and a transferring apparatus that are favorably used for forming a mark on the intermediate transfer belt, 2. Description of the Related Art Japanese Patent Applications Laid-Open (JPA) Nos. 11-160928 and 11-184203 disclose a method for preventing discrepancies in the positions of multiple toner images superimposed on an intermediate transfer belt in a color image-forming apparatus having a photosensitive body and an intermediate transfer belt. According to this method, a mark is formed on the intermediate transfer belt, and the timing of photosensitive drum exposure is controlled in accordance with the timing of detecting the mark.

In an image-forming apparatus of the kind described above, the mark has been commonly formed by affixing a photo-reflective tape onto the intermediate transfer belt. However, in such an image-forming apparatus, an intermediate transfer belt having almost no elasticity in the longitudinal direction thereof, such as a resin endless belt, has been employed and thus the mark would rarely peel off or break.

However, when a belt having a longitudinal elasticity is employed as the intermediate transfer belt and a mark for controlling an exposure timing is formed on the belt by affixing a photo-reflective tape thereon, there is a possibility that the mark formed on the belt would peel off or break by longitudinal stretch or contraction of the belt.

SUMMARY OF THE INVENTION

The present invention has been devised in view of the above circumstances and provides an intermediate transfer belt, an image-forming apparatus, a transfer sheet, a mark-forming method, and a transferring apparatus that solve the above problem.

The intermediate transfer belt of the present invention is an intermediate transfer belt having longitudinal elasticity, onto which a toner image formed on a photosensitive body of an image-forming apparatus is transferred, wherein a mark having a different photo reflectivity to the surface of the belt and used for detecting a reference position of the intermediate transfer belt is formed from photo-reflective particles on one or both sides thereof.

Since the mark is formed by fixing photo-reflective particles onto a surface of the intermediate transfer belt, the mark stretches and contracts in accordance with extension and contraction of the intermediate transfer belt. Thus, the mark neither peels off nor breaks due to extension and contraction of the intermediate transfer belt.

Further, the intermediate transfer belt is usually formed of an elastic material such as different kinds of vulcanized rubber or a thermoplastic elastomer and thus the surface thereof is uneven in the range of 5 to 10 μm. Therefore, when photo-reflective particles having a diameter of about 1/100 μm or less are selected, a majority of the particles will locate in the troughs between the irregularities of the intermediate transfer belt surface. Thus, the mark is not erased even when a scraper at an intermediate transfer-cleaning portion scrapes the intermediate transfer belt.

The present invention also relates to an image-forming apparatus comprising a photosensitive body on which a toner image is formed, an intermediate transfer belt described in the above onto which the toner image is transferred, a reference position-detection device detecting a reference position by optically detecting the mark formed on the intermediate transfer belt, and an exposure-control device controlling exposure timing on the photosensitive body in accordance with the reference position of the intermediate transfer belt detected by the reference position-detection device.

In the image-forming apparatus, the exposure-control device controls the exposure timing on the photosensitive body in accordance with a reference position of the intermediate transfer belt detected by the reference position-detection device. Thus, although a belt having longitudinal elasticity is employed as the intermediate transfer belt, there is no difference in transfer position between toner images when toner images in yellow (Y), magenta (M), cyan (C), and black (B) are respectively superimposed to form a full-color toner image. Therefore, a clear and vivid full-color image can be formed.

The present invention also relates to a transfer sheet comprising a photo-reflective particle layer formed of photo-reflective particles to be transferred onto an intermediate transfer belt, and an adhesive layer laminated on one side of the photo-reflective particle layer that is a layer of an adhesive for fixing the photo-reflective particles onto the intermediate transfer belt.

By sticking the adhesive layer to the intermediate transfer belt and then by applying pressure and, if necessary, heat to the photo-reflective particle layer, the photo-reflective particles can be fixed thinly and uniformly, and thus a mark having high photo reflectivity and high uniformity can be formed.

Additionally, the present invention relates to a mark-forming method for forming a mark for detecting a reference position of an intermediate transfer belt, wherein the adhesive layer of the transfer sheet mentioned in the above is attached to a surface of the intermediate transfer belt, following which heat and/or pressure are applied to the transfer sheet so as to transfer the photo-reflective particle layer to the intermediate transfer belt to form the mark.

According to the mark-forming method, a mark that does not peel off due to extension or contraction can be formed on an intermediate transfer belt having longitudinal elasticity.

Further, the present invention relates to a transferring apparatus for forming a mark by transferring a photo-reflective particle layer from a transfer sheet to an intermediate transfer belt, comprising a holder for holding the transfer sheet so that the adhesive layer faces the intermediate transfer belt, a plunger for plunging the holder toward and away from the intermediate transfer belt, and a stroke-retarding device for stopping the movement of the plunger when the transfer sheet is plunged into the intermediate transfer belt to a predetermined depth.

Use of the transferring apparatus enables formation of a mark that does not peel off due to extension or contraction can be formed on an intermediate transfer belt having longitudinal elasticity.

BRIEF DESCRIPTION OF THE DRAWINGS

Preferred embodiments of the present invention will be described in detail based on the following figures, wherein.

DESCRIPTION OF THE PREFERRED EMBODIMENTS

Figure 1:
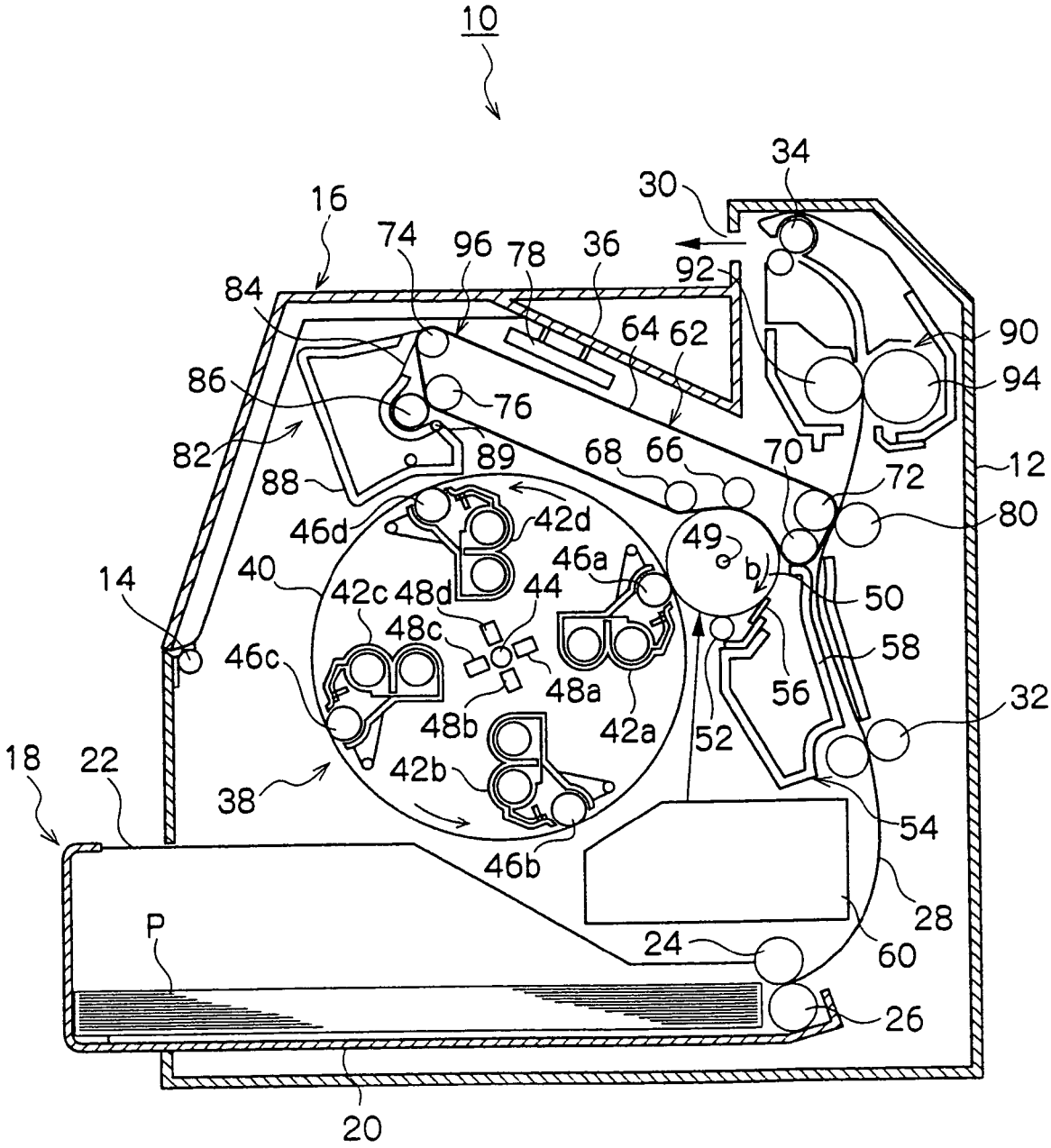
FIG. 1 is a sectional view showing an overall structure of an image-forming apparatus according to a first embodiment.

Although there is no limitation to the average diameter of photo-reflective particles employed in the intermediate transfer belt of the present invention, provided that the particles are sufficiently smaller than the irregularities on the surface of the intermediate transfer belt, the photo-reflective particles preferably have a diameter of from $1/10$ μm to $1/500$ μm, and particularly preferably, from $5/100$μ to $5/1000$ μm.

The photo-reflective particles can have a larger or smaller photo-reflectivity than the surface of the intermediate transfer belt. However, the intermediate transfer belt usually has a dark color and therefore, particles having larger photo-reflectivity than the surface of the intermediate transfer belt are preferably used.

Aluminum particles or particles formed by depositing aluminum on plastic beads produced by emulsion polymerization can be used as the photo-reflective particles. In addition, beads consisting of multiple transparent layers having different refraction, and reflecting light between the layers, are preferably employed.

A preferable example of the intermediate transfer belt includes an intermediate transfer belt wherein the photo-reflective particles are metal particles, and more specifically, aluminum particles, or metal-deposited particles formed by depositing a metal such as aluminum on the surface of particles.

Metal or metal-deposited particles have a metallic surface and, therefore, have high photo-reflectivity. Thus, for a mark formed of metal or metal-deposited particles on an intermediate transfer belt, optical detection can be accurately conducted.

A most preferable example of aluminum-deposited particles is plastic beads on the surface of which aluminum is deposited. Since plastic beads are produced by emulsion polymerization, and thus have very high sphericity and extremely smooth surfaces, aluminum-deposited plastic beads have high photo-reflectivity.

The mark is preferably formed by transferring the photo-reflective particles onto the intermediate transfer belt of the present invention by applying heat and/or pressure thereto.

As the photo-reflective particles can be thinly and uniformly fixed onto the intermediate transfer belt by applying heat and/or pressure, peeling off of the photo-reflective particles due to extension or contraction of the intermediate transfer belt is effectively prevented.

The transfer sheet of the present invention preferably has a release film layer disposed on the opposite side of the photo-reflective particle layer to the adhesive layer so as to support the photo-reflective particles and to be peeled off after the photo-reflective particle layer is transferred onto the intermediate transfer belt.

By using the above-mentioned transfer sheet, the mark can be more easily formed since the photo-reflective particle layer can be transferred by applying pressure and, if necessary, heat to the release film layer after sticking the adhesive layer onto an intermediate transfer belt.

The mark-forming method of the present invention is preferably practiced by applying pressure to the transfer sheet in order to transfer the photo-reflective particle layer and, when applying pressure, pressing the transfer sheet in the depth not larger than the thickness of the intermediate transfer belt.

According to the mark-forming method of the present invention as described above, the area of the intermediate transfer belt on which the mark is formed can be prevented from having less thickness than the area surrounding the mark, and formation of an uneven portion on the intermediate transfer belt can be effectively prevented.

In the transferring apparatus of the present invention, the amount of movement of the plunger is preferably determined by the stroke-retarding device such that the transfer sheet is pressed into the intermediate transfer belt to a depth not greater than the thickness of the intermediate transfer belt.

Use of the above transferring apparatus effectively prevents by that an area of the intermediate transfer belt on which the mark is formed being excessively pressed and forming an uneven portion or damaging the intermediate transfer belt.

1. First Embodiment

An example of the image-forming apparatus of the present invention is described in the below with reference to the figures.

As shown in FIG. 1, an image-forming apparatus 10 comprises a main body 12, a retractable cover 16 disposed pivotally at an upper portion of the main body 12 so as to rotate on an axle 14. A single paper supply unit 18 is disposed at a lower portion of the main body 12.

The paper supply unit 18 has a paper supply cassette 22 in which recording paper is stored. Adjacent to and slightly above the interior end of the paper supply cassette 22, a feed roller 24 for feeding the recording paper from the paper supply cassette 22, and a retard roller 26 for separating supplied recording paper into single sheet, are provided.

A conveyance path 28 is a paper-conveying path extending from the feed roller 24 to a discharge outlet 30 and is disposed close to a rear wall of the main body 12 (at the right-hand side of FIG. 1). The conveyance path 28 is formed substantially vertically from the paper supply unit 18 to fixing apparatus 90 described below.

On the conveyance path 28, a secondary transfer roller 80 and a secondary transfer back-up roller 72 is provided upstream of the fixing apparatus 90, and register rollers 32 are provided upstream of the secondary transfer roller 80 and the secondary transfer back-up roller 72. Further, discharge rollers 34 are provided close to the discharge outlet 30. A passively driven roller rotating passively while contacting an intermediate transfer belt 64 described below can be employed as the secondary transfer roller 80. A drive roller driven at the same circumference velocity as the rotational speed of the intermediate transfer belt 64 also can be used as the secondary transfer roller 80. When a drive roller is used as the secondary transfer roller 80, the secondary transfer roller 80 is preferably connected to a driving power source with a torque-limiter therebetween, so as to prevent generation of excessive torque between the secondary transfer roller 80 and the intermediate transfer belt 64.

A rotating developer 38 is provided at a substantially central portion of the main body 12, and a photosensitive drum 50 is disposed contiguous to the right side of the rotating developer 38. The photosensitive drum 50 rotates around a rotation axle 49. The photosensitive drum 50 corresponds to the photosensitive body of the present invention.

The rotating developer 38 has a developer main body 40. Developers 42*a* to 42*d* forming toner image in colors Y, M, C, and B, respectively, are provided inside the developer main body 40. The developer main body 40 rotates counter clockwise, as shown in FIG. 1, on axle 44. Each of the developers 42*a* to 42*d* is disposed at a peripheral portion of the developer main body 40 at an interval of 90 degree from the axle 44. The developers 42*a* to 42*d* are respectively provided with developing rollers 46*a* to 46*d*, and are respectively pressed in a radial direction of the developer main body 40 by elastic bodies 48*a* to 48*d*, which may be coil springs or the like. When not contacting with the photosensitive drum 50, portions of the circumferences of the developing rollers 46*a* to 46*d* protrude, for example, 2 mm beyond the circumference of the developer main body 40 in a radial direction. Additionally, tracking rollers having a slightly larger diameter (not shown in FIG. 1) are disposed at both ends of each of the developing rollers 46*a* to 46*d* so as to rotate on the same axle therewith. The tracking rollers of each of the developing rollers 46*a* to 46*d* contact with fringes (not shown) provided at both ends of the photosensitive drum 50 so as to form a predetermined amount of clearance between each of the developing rollers 46*a* to 46*d* and the photosensitive drum 50. Thus, a latent image formed on the photosensitive drum 50 is developed with Y toner, M toner, C toner, and B toner.

Below the photosensitive drum 50, a charging roller 52 that contacts with and charges the photosensitive drum 50 is provided. The charging roller 52 is disposed downstream of an image-support body cleaner 54 in the rotating direction 'b' of the photosensitive drum 50.

The image-supporting body cleaner 54 comprises a cleaning blade 56 for scraping off waste toner left on the photosensitive drum 50 after primary transfer, and a toner-retrieval bottle 58 for retrieving waste toner that the cleaning blade 56 has scraped off. Ribs or the like are formed on the rear (the right-hand side in FIG. 1) of the toner-retrieval bottle 58. The ribs have curved surfaces so that recording paper is smoothly conveyed, and form a portion of the conveyance path 28.

Below and to the right of the rotating developer 38, an exposure apparatus 60 that forms a latent image on the photosensitive drum 50 charged by the charging roller 52 by irradiating with a laser or the like is provided. Further, an intermediate transfer unit 62 is disposed above the rotating developer 38.

Figure 2:
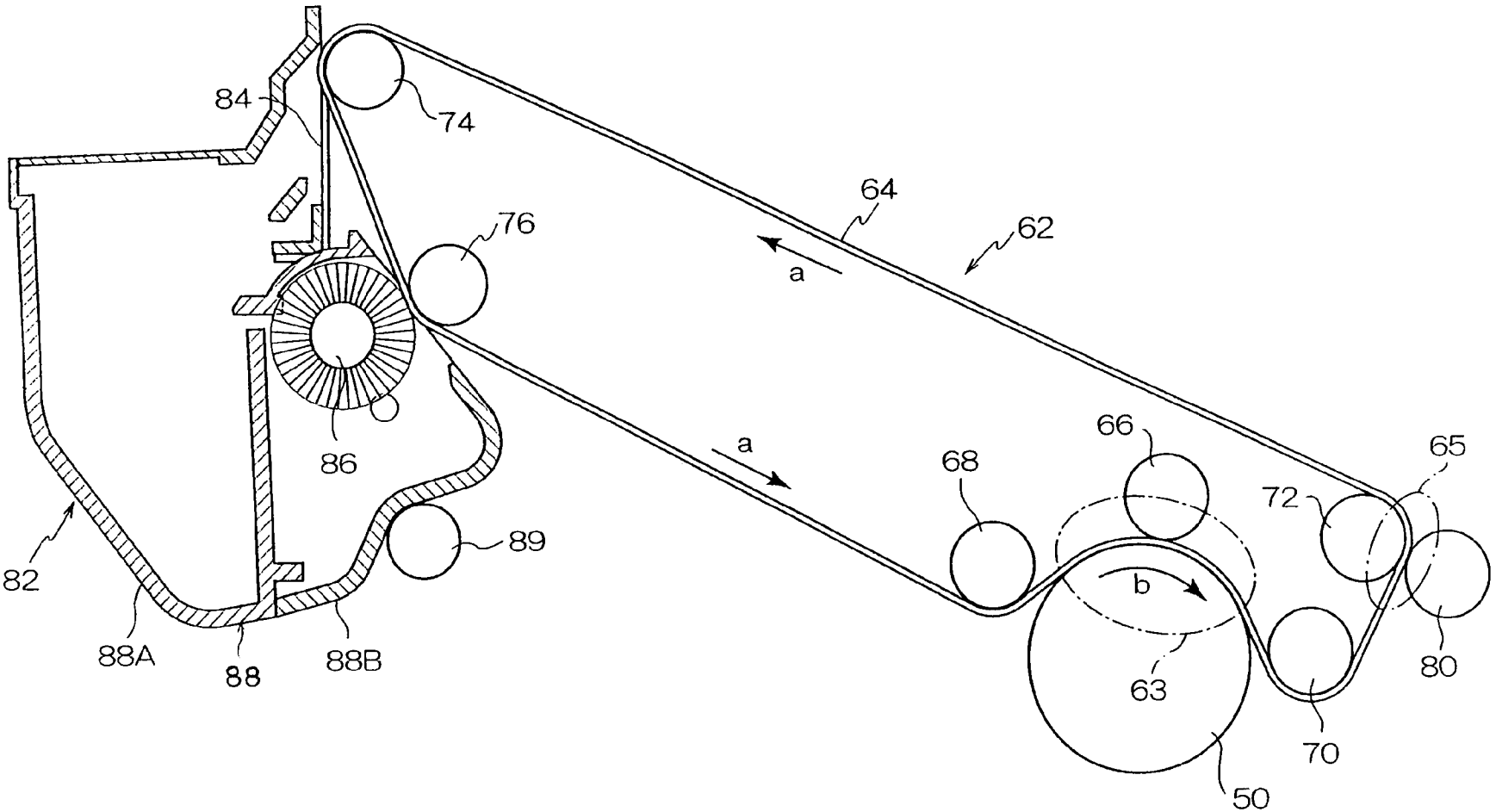
FIG. 2 is a sectional view showing a structure of an intermediate transfer unit of the image-forming apparatus shown in FIG. 1.

As shown in FIGS. 1 and 2, the intermediate transfer unit 62 comprises the intermediate transfer belt 64, a primary transfer roller 66, a wrap-in roller 68, a wrap-out roller 70, a secondary transfer back-up roller 72, a scraper back-up roller 74, a brush back-up roller 76 and the photosensitive drum 50.

The intermediate transfer belt 64 is stretched in a horizontally long rectangular shape above the rotating developer 38 by five rollers, that is, the wrap-in roller 68, the wrap-out roller 70, the back-up roller 72, the scraper back-up roller 74, and the brush back-up roller 76. A portion of the lower longer edge of the intermediate transfer belt 64 between the wrap-in roller 68 and the wrap-out roller 70 is wrapped over the photosensitive drum 50 to form a primary transfer portion 63. The wrap-in roller 68, the wrap-out roller 70, the secondary transfer back-up roller 72, the scraper back-up roller 74, and the brush back-up roller 76 are disposed in numerical order in a rotation direction 'a' of the intermediate transfer belt 64.

As shown in FIGS. 1 and 2, the wrap-in roller 68 and the wrap-out roller 70 contact, through the intermediate transfer belt 64, with the photosensitive drum 50 at a side opposite to the side at which the charging roller 52 contacts with the photosensitive drum 50.

As shown by an arrow 'b' in FIGS. 1 and 2, the photosensitive drum 50 rotates clockwise. The intermediate transfer belt 64 contacts with and is driven by the photosensitive drum 50 at the primary transfer portion 63 and, as shown by an arrow 'a', the intermediate transfer belt 64 rotates counter clockwise. Accordingly, a toner image on the photosensitive drum 50 is transferred onto the intermediate transfer belt 64 by the primary transfer roller 66.

Additionally, at the rear side (the right-hand side in FIG. 1) of the intermediate transfer belt 64, a flat portion is formed between the wrap-out roller 70 and the secondary back-up roller 72. The flat portion forms a secondary transfer portion 65 meeting the conveyance path 28.

Intermediate transfer body cleaner 82 is disposed at the opposite end of the intermediate transfer belt 64. The intermediate transfer body cleaner 82 comprises a toner-retrieval receptacle 88 that forms a housing of the intermediate transfer body cleaner 82, and a brush roll 86 that is pivotally supported inside the toner-retrieval receptacle 88. The toner-retrieval receptacle 88 rotates on a pivot 89 in a direction either approaching or withdrawing from the intermediate transfer unit 62.

Inside the toner-retrieval receptacle 88, a scraper 84 is disposed above the brush roll 86 so that the edge of the scraper 84 touches the intermediate transfer belt 64. The toner-retrieval receptacle 88 is separated into a primary retrieval receptacle 88A that receives toner removed by the scraper 84, and a secondary retrieval receptacle 88B that receives toner removed by the brush roll 86.

The intermediate transfer belt 64 is an endless belt that is elastic in the longitudinal direction thereof. Possible examples of the intermediate transfer belt 64 include an endless belt having a three-layer structure formed by disposing outer layers on both sides of an intermediate layer formed of chloroprene rubber or ethylene-propylene-diene co-polymer rubber. A mixture of a hydrophilic polyurethane resin, a polytetrafluoroethylene resin, carbon black and red iron oxide can be employed to form the outer layer.

Figures 3A, 3B:
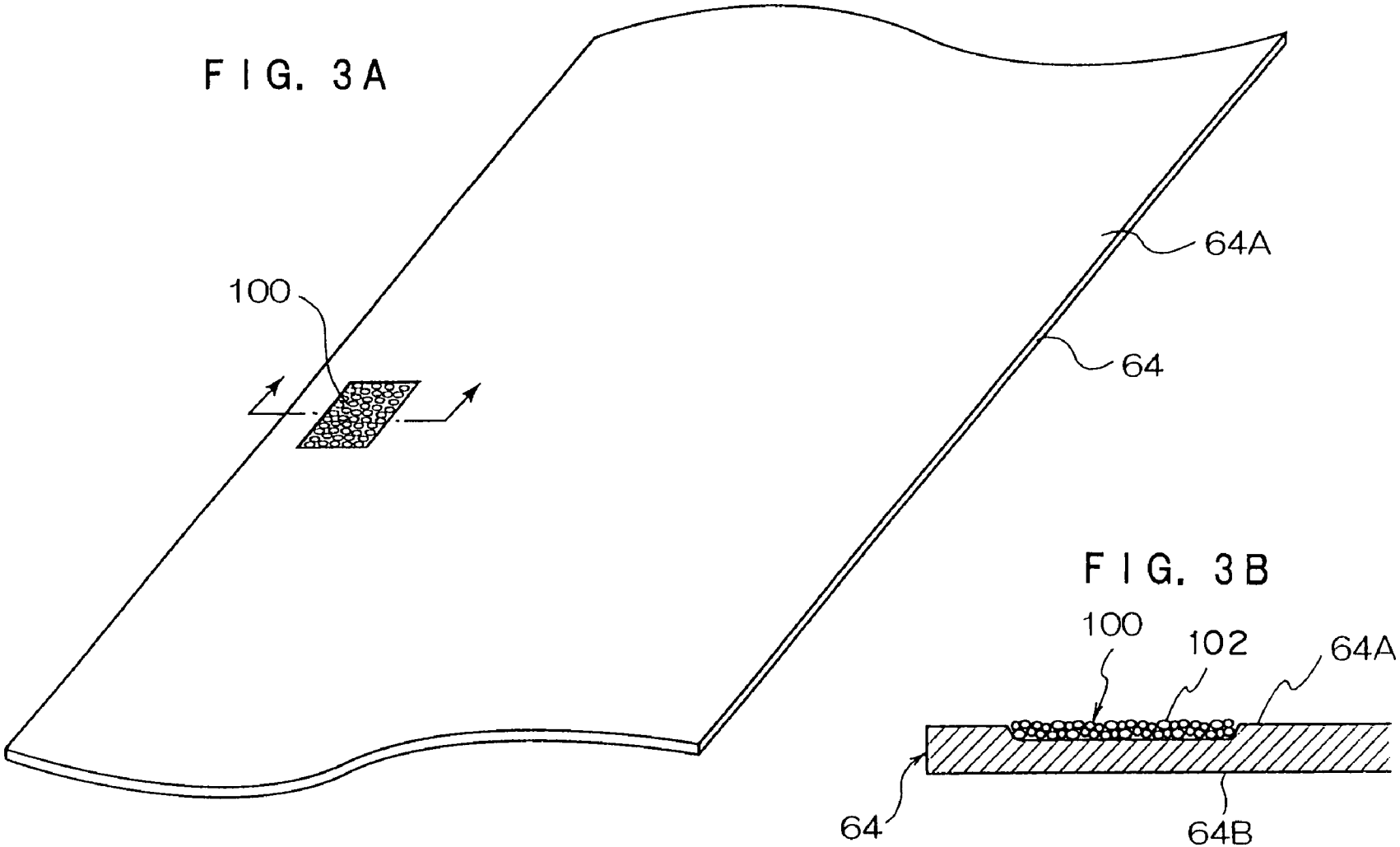
FIG. 3A is a partial perspective view showing a position-detection patch formed on an intermediate transfer belt of the image-forming apparatus shown in FIG. 1.
FIG. 3B is a sectional view showing a position-detection patch formed on an intermediate transfer belt of the image-forming apparatus shown in FIG. 1.

On an outer surface of the intermediate transfer belt 64 that is a toner image transfer surface 64A onto which a toner image is transferred, as shown in FIG. 3A, a rectangular location-detection patch 100, corresponding to the mark on the intermediate transfer belt of the present invention, is provided toward a lateral edge of the belt.

Figure 4:
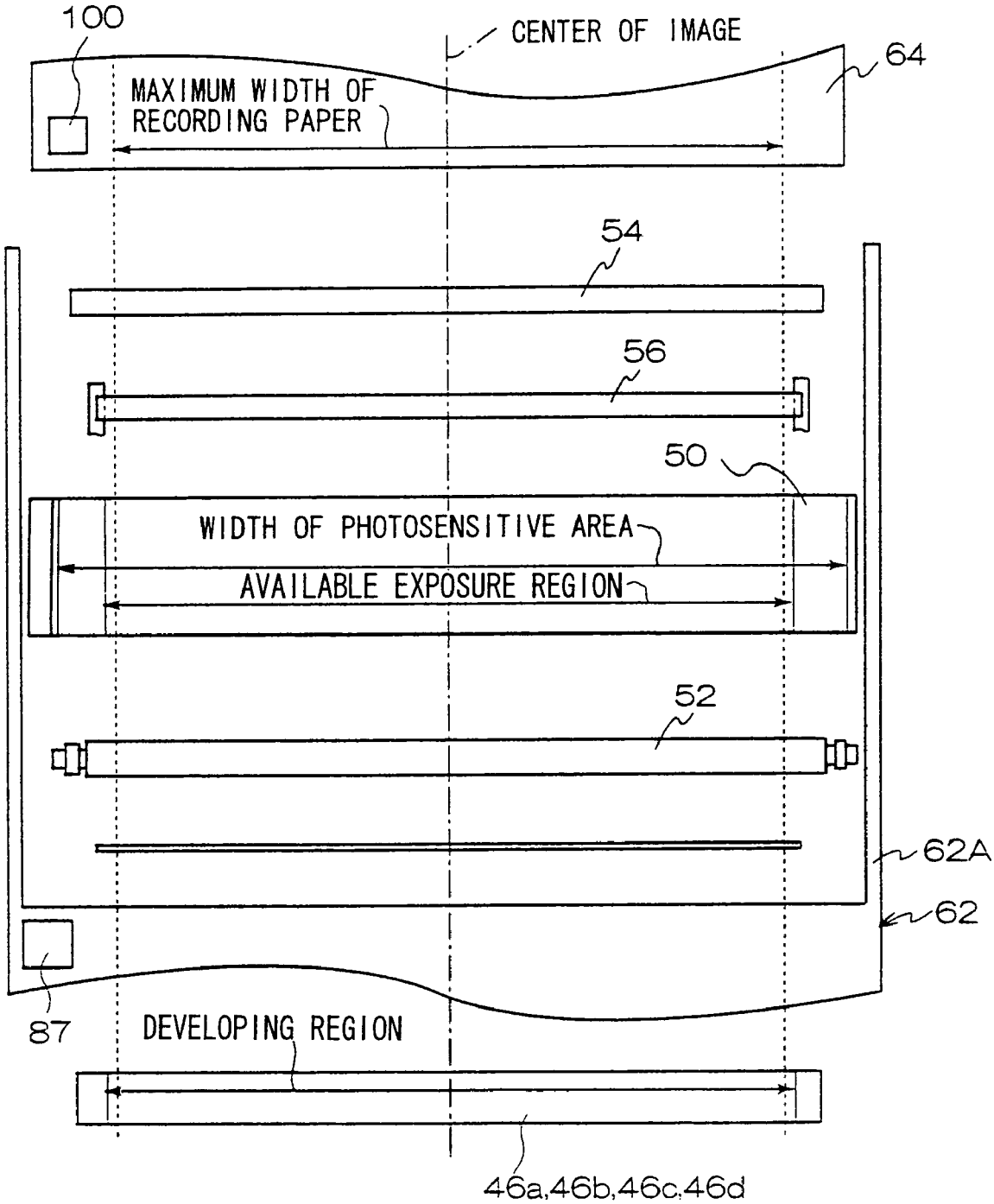
FIG. 4 is a schematic view showing a relative relationship of the location of the position-detection patch and the component units of the intermediate transfer unit of the image-forming apparatus shown in FIG. 1.
Figure 5:
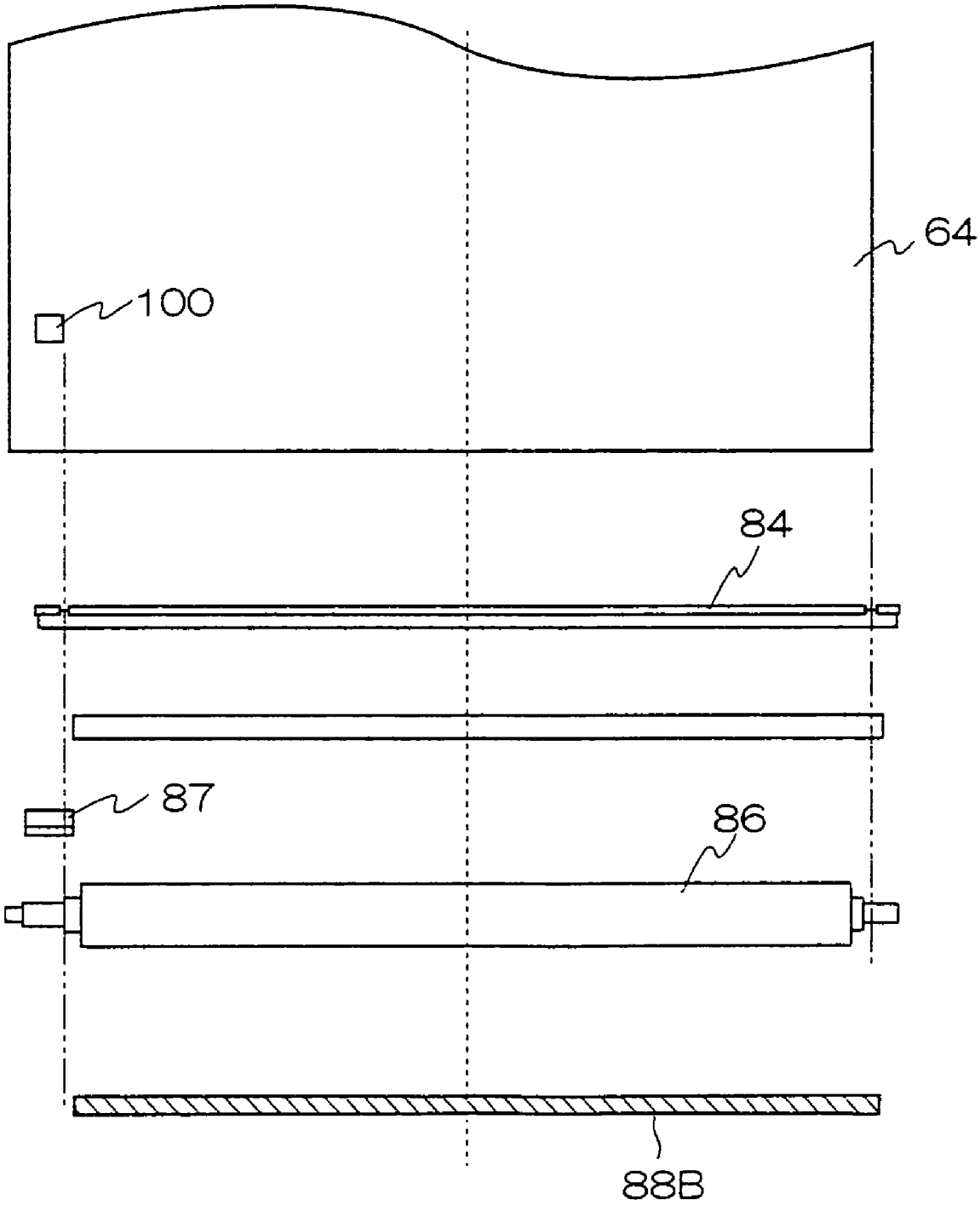
FIG. 5 is a schematic view showing a relative relationship of the location of the position-detection patch and the intermediate transfer body cleaner of the image-forming apparatus shown in FIG. 1.

As shown in FIGS. 4 and 5, the location-detection patch 100 is provided so as to be clear of an available exposure region of the intermediate transfer belt 64, as well as clear of an area cleaned by the brush roll 86. The available exposure region is the area of the photosensitive drum 50 exposed by the exposure apparatus 60 to form a toner image, As shown in FIGS. 4 and 5, a patch-cleaning brush 87 for cleaning the location-detection patch 100 is provided close to the brush roll 86 on an inside surface of an intermediate transfer unit housing 62A, which is the housing for the intermediate transfer unit 62.

Figure 6:
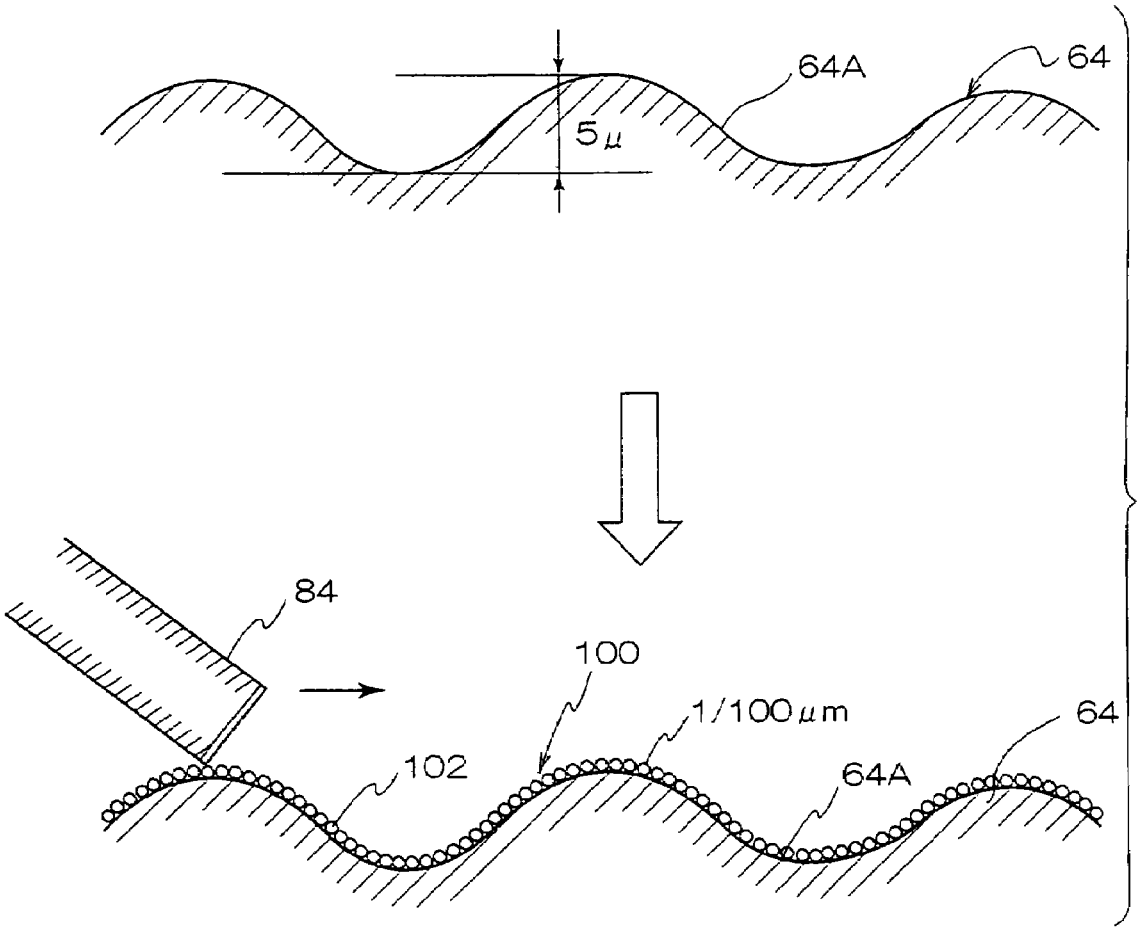
FIG. 6 is a schematic view showing a comparison of the height of irregularities on the intermediate transfer belt with the diameter of photo-reflective particles forming the position-detection patch.

As shown in FIG. 3B, the location-detection patch 100 is formed by fixing photo-reflective particles 102 with an adhesive to a predetermined location on the toner image transfer surface 64A using heat and/or pressure. A group of plastic particles obtained by emulsion polymerization, having a high sphericity, and having aluminum deposited on the surfaces thereof can be used as the photo-reflective particle 102. In addition, the portion of the toner image transfer surface 64A on which the location-detection patch 100 is disposed, is depressed to a level lower than the surrounding area. Further, 64B is an inside surface of the intermediate transfer belt 64. The photo-reflective particles 102 have a diameter of, for example, 1/100μ and thus, as shown in FIG. 6, are much smaller than the average distance of 5μ between the top and the bottom of irregularities on the toner image transfer surface 64A. Accordingly, if the photo-reflective particles 102 are fixed to the toner-image transfer surface by heat and/or pressure, at least the photo-reflective particles 102 in the trough of the irregularities remain intact on the toner image transfer surface 64A even after the toner image transfer surface 64A is scraped by the scraper 84.

Further, at an inside surface of the intermediate transfer unit housing 62A, a sensor 78 is disposed along the upper longer edge of the intermediate transfer belt 64. The sensor 78 is fixed to the rear surface (inner surface) of the retractable cover 16 and optically detects a position of a toner patch formed on the intermediate transfer belt 64 to detect whether the intermediate transfer belt 64 in following the correct path. The sensor 78 also detects the toner density of the toner patch. Additionally, the sensor 78 optically detects the location-detection patch 100 formed on the intermediate transfer belt 64 and controls exposure timing at the exposure apparatus 60 through a CPU (not shown in FIGS. 1 to 8). Thus, the sensor 78 and the CPU respectively correspond to the reference position-detection device and the exposure control device of the image-forming apparatus of the present invention, respectively.

As mentioned in the above, the secondary transfer roller 80 faces the secondary transfer back-up roller 72 of the intermediate transfer unit 62 with the conveyance path 28 therebetween to form the secondary transfer portion 65. The secondary transfer roller 80 conducts secondary transfer of a toner image, primarily transferred to the intermediate transfer belt 64, onto recording paper at the secondary transfer portion 65, assisted by the secondary transfer back-up roller 72. The secondary transfer roller 80 is at a position disengaged from the intermediate transfer belt 64 while the intermediate transfer belt 64 first turns three times, namely when Y, M and C toner images are transferred. After a B toner image is transferred to the intermediate transfer belt 64, the secondary transfer roller 80 contacts with the intermediate transfer belt 64. Predetermined difference in electric potential is formed between the secondary transfer roller 80 and the secondary transfer back-up roller 72 by, for example, applying a high voltage to the secondary transfer roller 80 and earthing the secondary transfer back-up roller 72.

A transfer sheet that can be used for forming the location-detection patch 100 on the intermediate transfer belt 64 is described in the following.

Figure 7A:
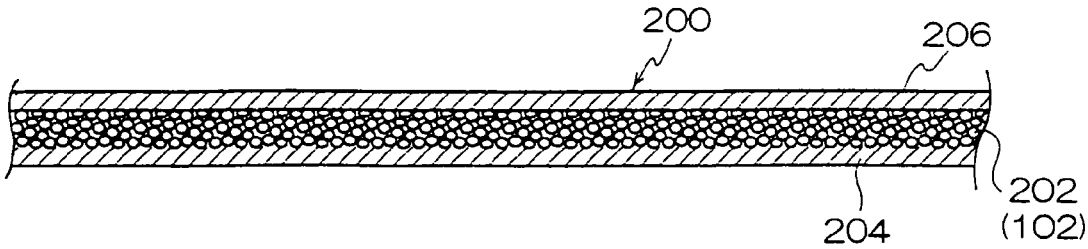
FIG. 7A is a schematic sectional view showing a structure of a transfer sheet used for forming the position-detection patch on a surface of the intermediate transfer belt.

As shown in FIG. 7A, a thermal transfer sheet 200 is formed of polyethylele telephthalate film and comprises a release film layer 206 that is pressed by a stamp, a photo-reflective particle layer 202 that is a layer formed of the photo-reflective particles 102 and is laminated on the side of the release film layer 206 opposite to the side pressed by the stamp, and an adhesive layer 204 formed on the side of the photo-reflective particle layer 202 opposite to the side on which the release film layer 206 is laminated. A release paper is preferably applied to the surface of the adhesive layer 204 for preventing the thermal transfer sheet 200 from sticking together when wound as described below. In addition, a press-sensitive adhesive forming the adhesive layer 204 preferably penetrates between the photo-reflective particles 102 since the photo-reflective particles 102 are thereby integrated by the press-sensitive adhesive and the photo-reflective particle layer 202 can also be integrated with the adhesive layer 204.

By using the thermal transfer sheet 200, the location-detection patch 100 can be formed on the intermediate transfer belt 64 by the following procedure.

Figure 7B:
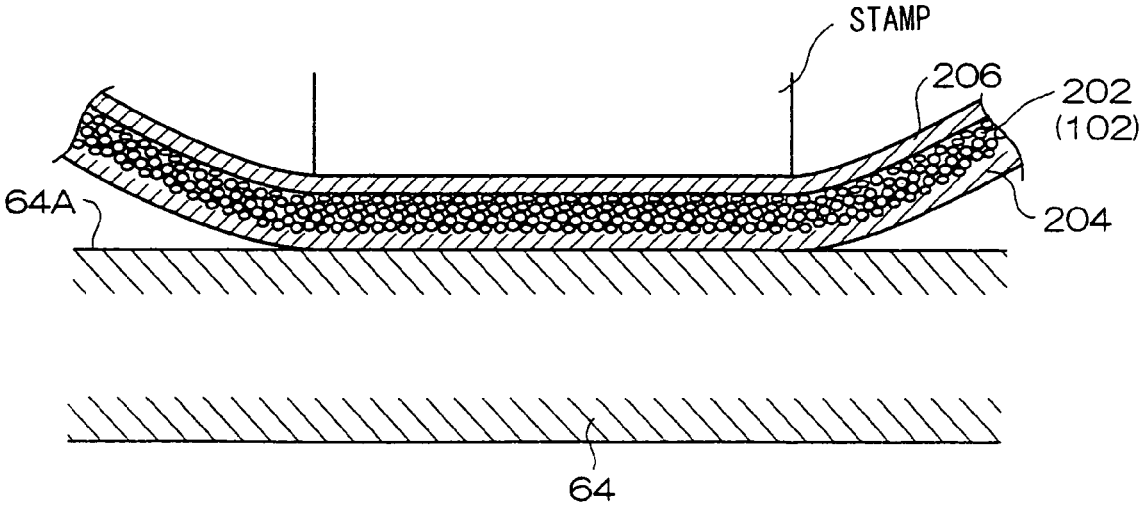
FIGS. 7B and 7C are process charts showing a thermal transfer process used for forming the position-detection patch on a surface of the intermediate transfer belt.
Figure 7C:
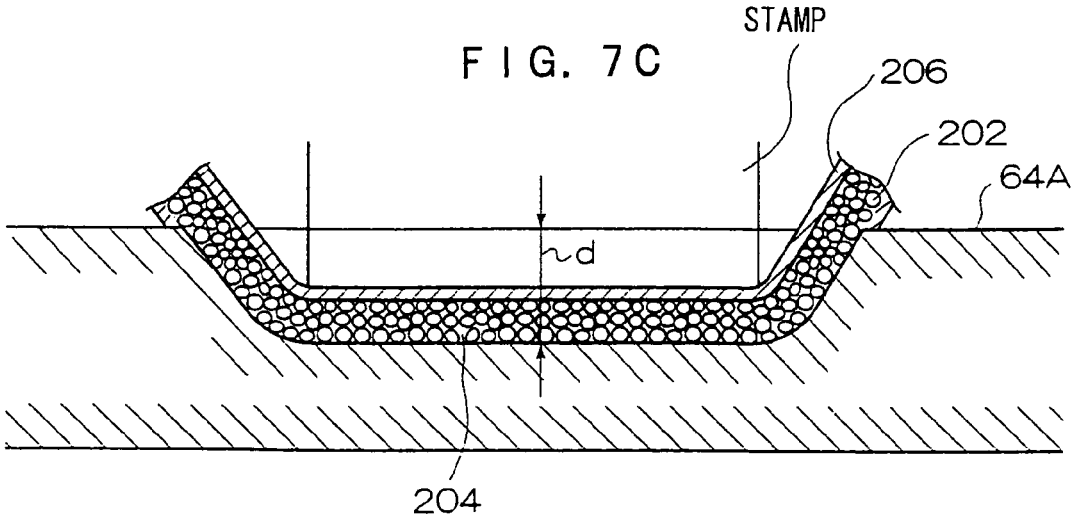

Firstly, as shown in FIG. 7B, the release paper is removed from the thermal transfer sheet 200 and the thermal transfer sheet 200 is then placed on a predetermined area of the intermediate transfer belt 64 with the side of the adhesive layer 204 facing the intermediate transfer belt 64. Secondly, the release film 206 of the thermal transfer sheet 200 is pressed to the intermediate transfer belt 64 by a stamp having a rectangular cross-section. Thirdly, as shown in FIG. 7C, the thermal transfer sheet 200 is pressed so that the intermediate transfer belt 64 is depressed to a depression depth of 'd' and heated. The depression depth 'd' preferably does not exceed the thickness of the intermediate transfer belt 64. After pressing the thermal transfer sheet 200 for several to ten seconds or more, the stamp is lifted upward. Then, the thermal transfer sheet 200 and the intermediate transfer belt 64 are sufficiently cooled and the release film 206 is removed. Thus, the photo-reflective layer 202 is thermally transferred to the intermediate transfer belt 64 and the location-detection patch 100 is formed.

A hot-stamping machine, which is an example of the transferring apparatus of the present invention and can be used for forming the location-detection patch 100 on the intermediate transfer belt 64, is described in the below.

Figure 8:
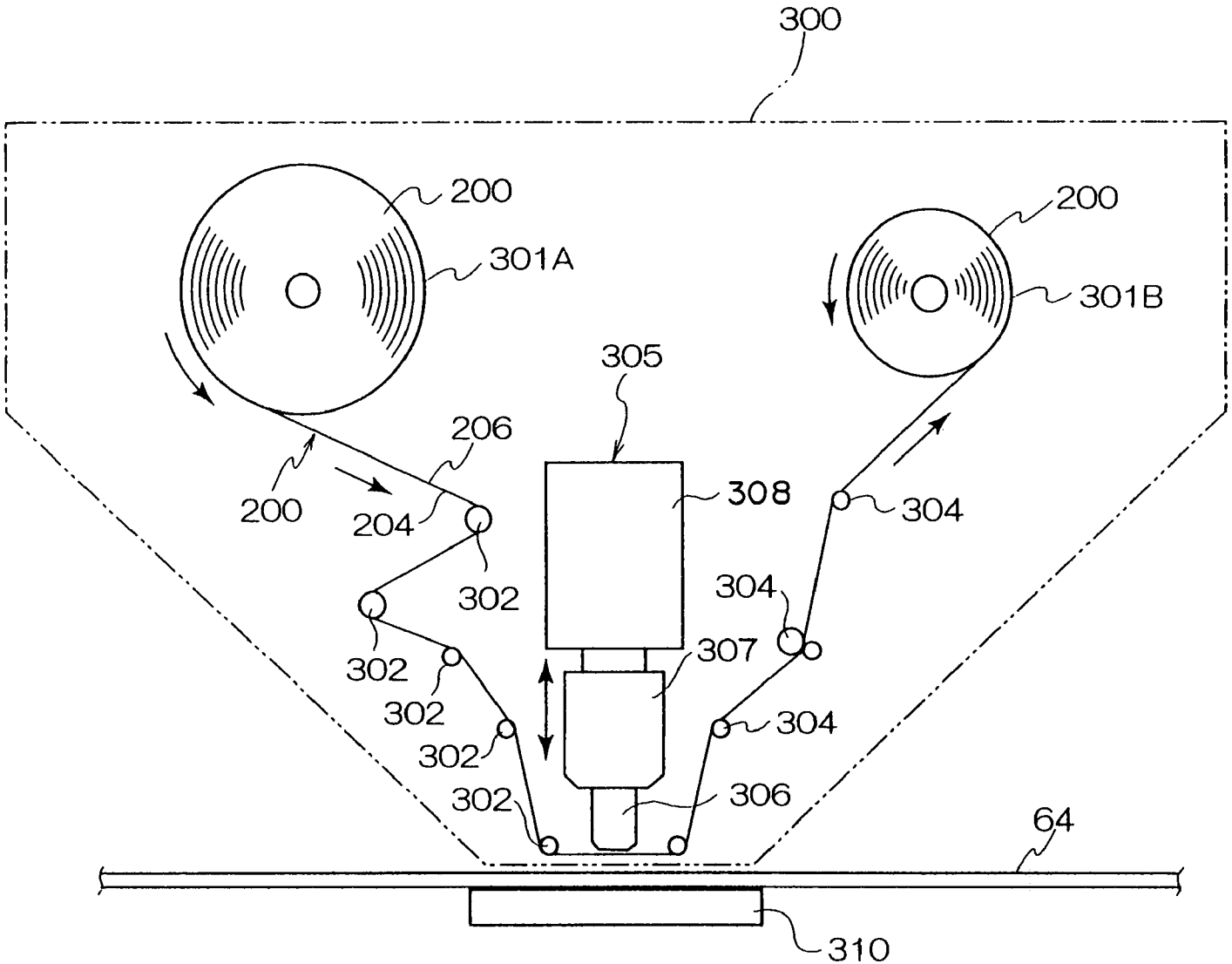
FIG. 8 is a schematic view showing a structure of a hot stamping machine used for forming the position-detection patch on a surface of the intermediate transfer belt.

As shown in FIG. 8, a hot-stamping machine 300 comprises an unwinding reel 301A for unwinding the thermal transfer sheet 200, a winding reel 301B winding the thermal transfer sheet 200 after forming the location-detection patch 100 on the intermediate transfer belt 64; a stamping portion 305 having a thermal transfer head 306 for transferring the location-detection patch 100 to the intermediate transfer belt 64; a pressing plate 310 fixed so as to face the thermal transfer head 306; a group of guide pins 302 for guiding the thermal transfer sheet 200 unwound from the unwinding reel 301A toward the thermal transfer head 306; a group of guide pins 304 for guiding the thermal transfer sheet 200, after photo-reflective particle layer 202 is thermally transferred by the thermal transfer head 306, toward the winding reel 301B.

The thermal transfer sheet 200 is wound on the unwinding reel 301A and the winding reel 301B so that the release film 206 faces inwards.

The stamping portion 305 consists of a head-heating portion 307 at which the thermal transfer head 306 is fixed and, by which it is heated at a predetermined temperature, and a driving device 308 for moving the head-heating portion 307 and the thermal transfer head 306 toward and away from the pressing plate 310. The driving device 308 is formed such that a stroke plunging the head-heating portion 307 and the thermal transfer head 306 toward the intermediate transfer belt 64 can be set. However, the stroke cannot be set so that the depression depth, which is the depth of the depression plunged by the thermal transfer head 306 on the intermediate transfer belt 64, exceeds the thickness of the intermediate transfer belt 64. The guide pins 302 and the guide pins 304 correspond to the holder of the transferring apparatus of the present invention. The driving device 308 corresponds to the plunger and the stroke-controlling device of the transferring apparatus.

The operation of the hot-stamping apparatus 300 is described in the following.

The thermal transfer sheet 200 unwound from the unwinding reel 301A is held by the guide pins 302 so that the adhesive layer 204 faces outwards and is conveyed toward the thermal transfer head 306.

Thus, by heating the thermal transfer head 306 to a predetermined temperature with the head-heating portion 307 and moving the head-heating portion 307 and the thermal transfer head 306 with the driving device 308, the photo-reflective layer 202, heated by the thermal transfer head 306, is thermally transferred by heat and pressure in a rectangular shape to the intermediate transfer belt 64 to form the location-detection patch 100.

Then, the thermal transfer sheet 200 is guided by the guide pins 304 towards the winding reel 301B and wound into the winding reel 301B.

Function of the image-forming apparatus 10 of the first embodiment is described in the below.

When the sensor 78 detects the location-detection patch 100, the CPU inputs an image signal to the exposure apparatus 60, and the exposure apparatus 60 exposes the photosensitive drum 50, which is negatively charged by the charging roller 52, and a latent image is formed on the surface of the photosensitive drum 50. Then, the rotating developer 38 rotates to a position so that a predetermined developer from among the developers 42*a* to 42*d* faces the photosensitive drum 50, and the latent image on the photosensitive drum 50 is developed with toner of a predetermined color from among Y, M, C, B to form a toner image.

Then, the photosensitive drum 50 rotates in the direction of arrow 'b' and the toner image is transferred to the intermediate transfer belt 64 at the primary transfer portion 63.

Waste toner left on the photosensitive drum 50 after transfer of the toner image formed thereon, and positively charged toner adsorbed by the photosensitive drum 50 are scraped off by the image-support body cleaner 54 and retrieved.

The same procedure from detection of the location-detection patch 100 to toner image formation on the photosensitive drum 50 is repeated for each of the Y, M, C, and B toners. Thus, toner images of each color are superimposed on the intermediate transfer belt 64 to form a full-color toner image. However, the secondary transfer roller 80 is disengaged from the intermediate transfer belt 64 until after a C-toner image is imposed and, accordingly, no secondary transfer occurs therebefore.

On the other hand, recording paper contained in the paper-supply cassette 22 is delivered by the feeding roller 24, separated into single sheets by the retard roller 26 and introduced into the conveyance path 28. Then the recording paper is temporarily stopped by the register rollers 32. Then, when the C-toner image is superimposed, the secondary roller 80 engages with the intermediate transfer belt 64 to form the secondary transfer portion 65. The recording paper is introduced into the secondary transfer portion 65 so as to coincide with the timing of transferring and superimposing a B-toner image.

At the secondary transfer portion 65, the full-color toner image formed by superimposing toner images of Y, M, C, and B on the intermediate transfer belt 64 is transferred onto the introduced recording paper.

The recording paper onto which the toner image is transferred is introduced into the fixing apparatus 90 and the toner image is fixed by heat and pressure applied by heating rollers 92 and a press roller 94.

Then the recording paper on which the toner image is fixed is discharged from the discharge outlet 30 into a discharge portion 36 by discharge rollers 34.

As shown in FIG. 2, waste toner left on the intermediate transfer belt 64 after secondary transfer of the full-color toner image to the recording paper is conveyed by the intermediate transfer belt 64 in the direction of arrow 'a' and removed by the intermediate transfer body cleaner 82.

In the image-forming device 10, the location of the location-detection patch 100 is detected and the timing of forming toner images in each of the colors of Y, M, C, and B is controlled in accordance with the detected position of the location-detection patch 100. Accordingly, differences in the transfer position of toner images can be minimized and thus, vivid and clear full color image can be formed.

Additionally, since the location-detection patch 100 is formed by thermally transferring the photo-reflective particles 102 onto the intermediate transfer belt 64 using adhesive, heat, and pressure, the photo-reflective particles 102 do not detach from the intermediate transfer belt 64 even as a result of stretching and contracting thereof. In addition, the photo-reflective particles are spherical particles of a plastic covered with an aluminum layer deposited thereon and, thus, have a high photo-reflectivity. Accordingly, even a location-detection patch 100 having a small area can be optically detected accurately.

Further, when the thermal transfer sheet 200 is pressed onto the intermediate transfer belt 64 and thermally transferred thereto, since pressure is not applied to an extent that might cause deformation of the intermediate transfer belt 64, formation of the location-detection patch 100 does not cause loosening or distortion of the intermediate transfer belt 64.

What is claimed is:

1. An intermediate transfer belt having a longitudinal elasticity and onto which a toner image formed on a photosensitive body of an image-forming apparatus is transferred, wherein a mark having a different photo reflectivity than a surface of the intermediate transfer belt and used for detecting a reference position of the intermediate transfer belt is formed by photo-reflective particles on at least one side of the intermediate transfer belt;

wherein the photo-reflective particles are smaller than irregularities on the surface of the intermediate transfer belt.

2. The intermediate transfer belt of claim 1, wherein the photo-reflective particles are metal particles or metal deposited particles.

3. The intermediate transfer belt of claim 1, wherein the mark is formed by transferring the photo-reflective particles thereon with heat and/or pressure.

4. The intermediate transfer belt of claim 2, wherein the mark is formed by transferring the photo-reflective particles thereon with heat and/or pressure.

5. An image-forming apparatus comprising:

a photosensitive body on which a toner image is formed;

the intermediate transfer belt of claim 1 onto which the toner image is transferred;

a reference position-detection device which detects a reference position by optically detecting the mark formed on the intermediate transfer belt; and an exposure control device controlling an exposure timing on the photosensitive body in accordance with a reference position of the intermediate transfer belt detected by the reference position-detection device.

6. An image-forming apparatus comprising a photosensitive body on which a toner image is formed, an intermediate transfer belt of claim 2 on which the toner image is transferred, a reference position-detection device detecting a reference position by detecting optically the mark formed on the intermediate transfer belt, and an exposure control device for controlling an exposure timing on the photosensitive body in accordance with the reference position of the intermediate transfer belt detected by the reference position-detection device.

7. An image-forming apparatus comprising:

a photosensitive body on which a toner image is formed;

the intermediate transfer belt of claim 3 onto which the toner image is transferred;

a reference position-detection device for detecting a reference position by optically detecting the mark formed on the intermediate transfer belt; and an exposure control device for controlling an exposure timing on the photosensitive body in accordance with the reference position of the intermediate transfer belt detected by the reference position-detection device.

8. An image-forming apparatus comprising:

a photosensitive body on which a toner image is formed;

the intermediate transfer belt of claim 4 on which the toner image is transferred;

a reference position-detection device for detecting a reference position by optically detecting the mark formed on the intermediate transfer belt; and an exposure control device for controlling an exposure timing on the photosensitive body in accordance with a reference position of the intermediate transfer belt detected by the reference position-detection device.

9. The intermediate transfer belt of claim 1, wherein the photo-reflective particles have a diameter from $1/10$ μm to $1/500$ μm.

10. The intermediate transfer belt of claim 1, wherein the photo-reflective particles have a diameter from $5/100$ μm to $5/1000$ μm.

11. The intermediate transfer belt of claim 1, wherein the photo-reflective particles comprise plastic beads and a metal deposited on a surface of the plastic beads.

12. The intermediate transfer belt of claim 1, wherein the photo-reflective particles have a larger photo-reflectivity than the surface of the intermediate transfer belt.

* * * * *